US008171943B2

(12) United States Patent
Hamano

(10) Patent No.: US 8,171,943 B2
(45) Date of Patent: May 8, 2012

(54) SYSTEM AND METHOD FOR APPLYING AND REMOVING COSMETIC HAIR USING BIOMIMETIC MICROSTRUCTURE ADHESIVE LAYER

(76) Inventor: Miles M. Hamano, Honolulu, HI (US)

( * ) Notice: Subject to any disclaimer, the term of this patent is extended or adjusted under 35 U.S.C. 154(b) by 677 days.

(21) Appl. No.: 12/195,328

(22) Filed: Aug. 20, 2008

(65) Prior Publication Data

US 2010/0043814 A1 Feb. 25, 2010

(51) Int. Cl.
*A41G 3/00* (2006.01)
*A41G 5/00* (2006.01)

(52) U.S. Cl. ..... 132/201; 132/54

(58) Field of Classification Search ..... 132/53–56, 132/107, 134, 219, 201
See application file for complete search history.

(56) References Cited

U.S. PATENT DOCUMENTS 4,509,539 A * 4/1985 Alfieri ..... 132/53
5,694,953 A * 12/1997 Stephan et al. ..... 132/160
6,872,439 B2 * 3/2005 Fearing et al. ..... 428/99
7,229,685 B2 6/2007 Full
7,335,271 B2 2/2008 Autumn
2004/0112400 A1 * 6/2004 Kurek ..... 132/218
2007/0119468 A1 * 5/2007 Hochi ..... 132/53

FOREIGN PATENT DOCUMENTS

WO W02005065619 7/2005

* cited by examiner

*Primary Examiner* — Todd Manahan
*Assistant Examiner* — Brianne Kalach
(74) *Attorney, Agent, or Firm* — Leighton K. Chong

(57) ABSTRACT

A cosmetic hair assembly has a shaped piece of wig netting or mesh holding a plurality of cosmetic hairs attached to a correspondingly shaped layer of biomimetic microstructure adhesive (BMA) with tiny synthetic seta for adhesion to human skin. The wig netting is dimensioned slightly larger than the BMA layer to leave a slight overhanging part to facilitate removal from the skin by peeling back the overhanging part. A comb with peeler in the form of hooked portions can be used to peel back the wig netting. In another embodiment, an individual cosmetic hair assembly has a hair shaft attached to a substrate portion attached to a BMA layer, wherein the substrate's edges provide engagement surfaces to facilitate removal by peeling back the BMA layer. An applicator in the form of a thin water-soluble transfer sheet can hold a number of cosmetic hair assemblies until they are ready to be applied.

17 Claims, 3 Drawing Sheets

PEELER IN OPERATION

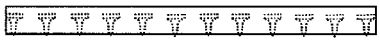
FIG. 3A
PLAN VIEW
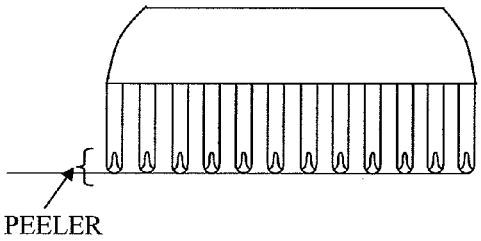
FIG. 3B
ELEVATION VIEW
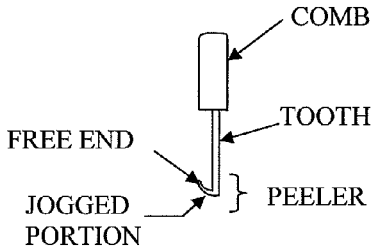
FRONT VIEW
FIG. 3C
COMB WITH PEELER
FIG. 4
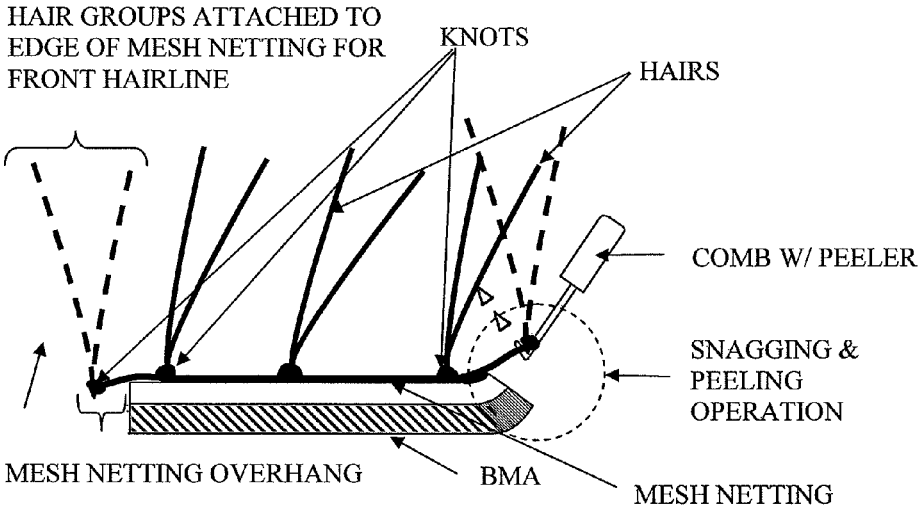
PEELER IN OPERATION

FIG. 5
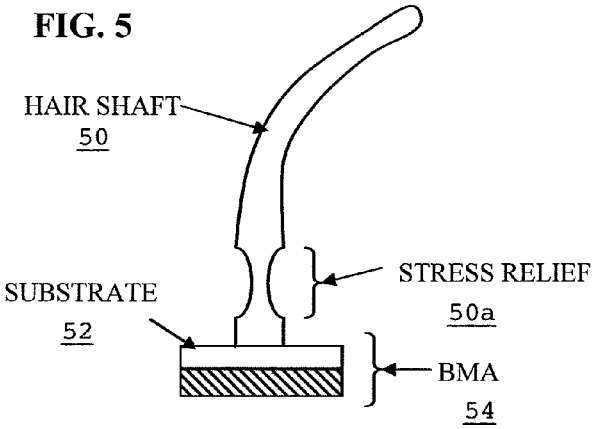
COSMETIC HAIR
FIG. 7
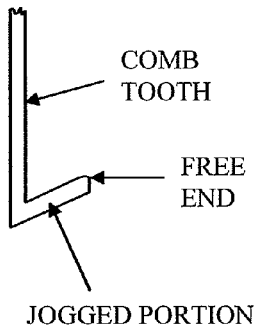
PEELER
FIG. 6A TOP VIEW
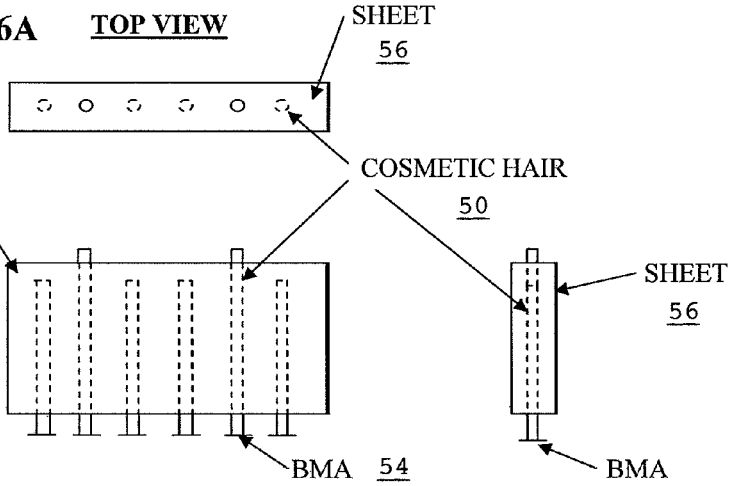
ELEVATION VIEW
FRONT VIEW
FIG. 6B
FIG. 6C
APPLICATOR

SYSTEM AND METHOD FOR APPLYING AND REMOVING COSMETIC HAIR USING BIOMIMETIC MICROSTRUCTURE ADHESIVE LAYER

TECHNICAL FIELD

This invention relates to a system and method for applying and removing cosmetic hair, in particular, cosmetic hair using a biomimetic microstructure adhesive (BMA) for adhesion to the scalp.

BACKGROUND OF THE INVENTION

There is an ongoing need for improvements in personal grooming and cosmetic care. In particular, it is highly desired to attach cosmetic hair to the human skin with good adhesion during use, while also being readily detached from the skin when desired.

Biomimetic microstructure adhesives (BMA) have been developed recently based on scientific research how animals such as geckos are able to climb up smooth vertical surfaces using adhesion forces generated by their toes. The mechanism of toe adhesion of geckos is attributed to the morphology of its unique toe hairs, called "seta", in creating and releasing suction by the physical movements of the toes. Synthetic adhesives mimicking the natural seta have been developed, for example, as described in U.S. Pat. No. 7,011,723 issued Mar. 14, 2006, to R. Full et al., and U.S. Pat. No. 6,872,439, issued Mar. 29, 2005, to R. Fearing et al. Various methods have also been developed to manipulate BMA adhesive structures for improved holding of a substrate to a support surface, such as described in U.S. Pat. No. 6,722,026, issued Apr. 20, 2004, to M. Lent, and in U.S. Published Application 2005/0148984 of Lindsay et al, published Jul. 7, 2005.

However, the prior methods have not provided ways to employ BMA adhesives for holding an object to and easily releasing it from human skin through simple and convenient means. In particular, it would be desirable to use BMA adhesive to hold cosmetic hair in contact with the human scalp, yet be able to easily release the object from the skin without causing any discomfort or pain to the user.

SUMMARY OF INVENTION

In accordance with the an embodiment of the present invention, a cosmetic hair assembly comprises a shaped piece of wig netting or mesh holding a plurality of hairs on an upwardly facing side thereof, and a correspondingly shaped layer of biomimetic microstructure adhesive (BMA) which has tiny synthetic seta on a downwardly facing side for adhesion to human skin and an upwardly facing side that is fastened to a downwardly facing side of the wig netting, wherein the wig netting is dimensioned to be slightly larger than the BMA layer so as to leave a slight overhang of the wig netting extending beyond the BMA layer.

The cosmetic hair assembly is installed by placing an appropriately shaped piece on a bare spot of the wearer's scalp with the downwardly facing adhesion side of the BMA layer in contact with the wearer's skin. When it is desired to remove the cosmetic hair assembly, a comb or other removal device can be used to pick up a part of the wig overhang and pull it at an inclined angle back from the scalp, thereby releasing the seta of the BMA layer from the skin by "peeling" it back.

In a preferred embodiment, a specially designed comb has a peeler in the form of small hooked portions at the ends of the comb's teeth for hooking the overhanging part of the wig netting and peeling the cosmetic hair assembly from the scalp.

As a further embodiment of the invention, an individual strand or group of cosmetic hair assembly is comprised of a small biomimetic microstructure adhesive (BMA) layer attached to a substrate portion to which a hair shaft is attached. An applicator is formed as a transfer sheet for holding one or more of the cosmetic hair until it is ready to be applied. The sheet is preferably formed as a thin rectangular layer of a water-soluble, flexible, non-stick material in which the cosmetic hair is embedded with their BMA layers exposed all on the same side. The applicator sheet can be rolled into a cylinder with the BMA layer ends exposed at one end, then applied by pressing the BMA ends against the bald spot to attach the hair ends to the skin in the bald spot. After the user has attached the individual hairs desired, the transfer sheets are wetted with water (or other solvent) and dissolved to leave the cosmetic hairs in place on the head. A comb peeler similar to the one previously described can be used to remove the cosmetic hairs by dragging the jogged portions of the comb teeth over the bald spots, so that the free ends catch under the substrate edges of the BMA layers to peel off the cosmetic hairs.

Other objects, features, and advantages of the present invention will be explained in the following detailed description of the invention having reference to the appended drawings.

BRIEF DESCRIPTION OF DRAWINGS

FIGS. 3A, 3B, and 3C show plan, elevation, and front views, respectively, of a comb with peeler for removing the cosmetic hair assembly.

FIG. 4 illustrates the attachment of groups of hair strands at discrete points to the wig mesh or netting.

FIG. 5 shows an individual cosmetic hair assembly using a biomimetic microstructure adhesive (BMA) layer.

FIGS. 6A, 6B, and 6C show plan, elevation, and front views, respectively, of an applicator for applying the individual cosmetic hair to the user's head.

FIG. 7 shows a comb peeler for releasing the individual cosmetic hair from the user's head.

DETAILED DESCRIPTION OF THE INVENTION

Figure 1:
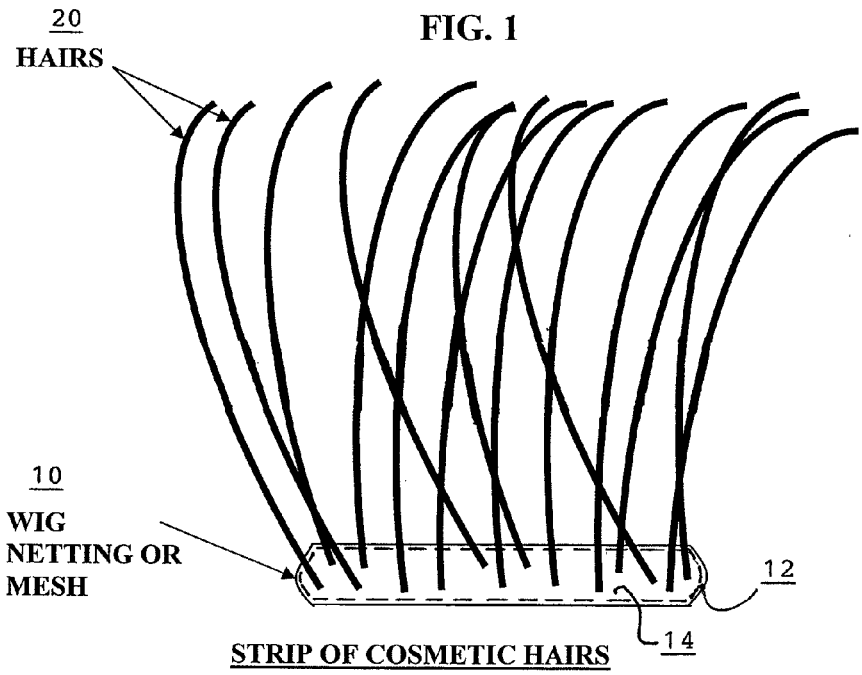
FIG. 1 shows a cosmetic hair assembly using a biomimetic microstructure adhesive (BMA) layer in accordance with the present invention.

The present invention utilizes the unique surface adhesion properties of synthetic biomimetic microstructure adhesives (BMA) in a cosmetic hair assembly. BMA adhesives are based on mimicking the adhesion properties of a gecko's toes with its unique toe hairs, called "seta". Each seta has a shaft and an array of paddle-shaped spatulae at the end of the shaft. Adhesion is produced as the spatulae come into intimate contact with a surface. In general, the seta shaft is about 10 to 100 microns long, and the diameter of the shaft is about 0.05 times the length of the shaft. The adhesion property of a seta is found to be produced by its three-dimensional orientation pointing toward or away from the surface, and is enhanced when the seta is preloaded, i.e., pushed into and pulled along in contact with the surface, during initial contact.

The orientation of the setae is also important in detachment. It has been reported that the setae are more readily detached when pulled away at an inclined angle back from the surface. Detachment at an angle corresponds to observed movements of the gecko's toes during locomotion. Geckos have been observed to peel the tips of their toes away from a smooth surface during running. Toe peeling may put an individual seta in an orientation or at a critical angle that aids in its release. Secondly, toe peeling concentrates the detachment force on only a small subset of all attached setae at any instant.

By mimicking the natural seta, artificial seta microstructures have been fabricated having the adhesion property of gecko setae for use as an adhesive, such as disclosed in U.S. Pat. No. 7,011,723 to R. Full et al., and U.S. Pat. No. 6,872,439 to R. Fearing et al. Synthetic BMA adhesives may be fabricated by extruding liquid polymer, forming a flattened cup or mushroom shape, then curing. Alternatively, a nano-channel glass, which consists of a large bundle of hollow glass fibers, can be filled with a polymer, and then the glass can be dissolved in an acid. Stalks and spatulae may also be formed from a mold using a nano-imprinting roller. Artificial BMA arrays can be fabricated with millions of synthetic setae rooted to a support layer, which can be manipulated, shaped and/or sized for any suitable use.

There are two main types of BMA adhesives. The first type is anisotropic (directional adhesion/friction), e.g., earlier versions of BMAs were of this type. The second type is isotropic (non-directional adhesion/friction), e.g., BMA adhesives using microfibers, nanotubes, etc., are of this type. In the following description, the preferred embodiments are described using isotropic type BMA adhesives for more flexible and convenient. While anisotropic BMA adhesives may also be used in the described applications, special consideration must be given to the directionality of anisotropic BMA adhesives to properly design and configure devices for a given application.

In the present invention, the adhesion and removal properties of BMA adhesives are adapted for cosmetic hair application. There is a high demand for improved cosmetic hair application for treating baldness and thinning hair (alopecia) problems. At present, the options for treating baldness and thinning hair problems, besides wearing wigs, are topical, oral, medical or surgical treatments. Most of the existing treatments that work require involvement of specialists and are very expensive. The topical, oral and medical treatments can promote the re-growth of hairs, but work best for hair loss due to medication, hormonal imbalance, thyroid problems or some underlying cause such as diabetes. Even when re-growth of hairs is stimulated, the density and volume of the new hairs will likely fall short of expectations.

The only sure ways conventionally to achieve a dense and long-lasting volume of cosmetic hair are surgical treatments and wigs. Surgical treatments are costly, painful, and are difficult to adapt to changing circumstances, such as matching changing hair color or the opening of new areas of baldness. Wigs can be unstable if worn by a netting on the head, or uncomfortable and difficult to remove if held in place with adhesives. Therefore, a system and method for applying and removing cosmetic hair to be physically stable on the head, comfortable to wear, adaptable to changing circumstances, and easily removable is desired.

Referring to FIG. 1, a cosmetic hair assembly in accordance with the present invention is shown in the exemplary form of a small strip or patch that can be readily applied to, held stably on, and easily removed from a bald spot on the head. The cosmetic hair assembly has a shaped piece of wig netting or mesh 10 holding a plurality of hairs 20 on an upwardly facing side thereof, and a matching shaped layer 14 of biomimetic microstructure adhesive (BMA) having tiny setae on a downwardly facing side thereof. The shaped piece 10 is dimensioned slightly larger than the BMA layer 14 so as to have a slightly overhanging part 12 extending around the edges thereof.

Figure 2:
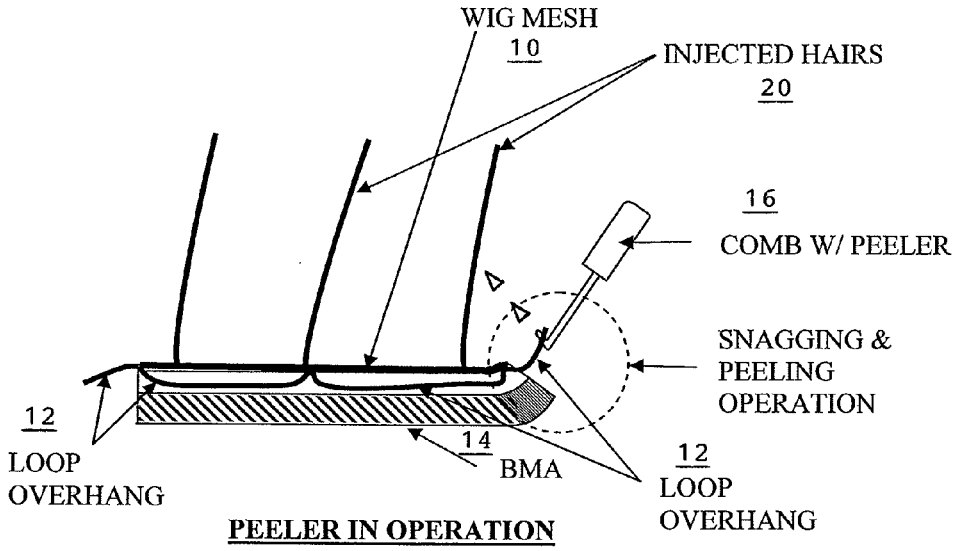
FIG. 2 shows details of the peeling operation in side view of the cosmetic hair assembly with the BMA layer attached to the wig netting.

As shown in greater detail in the side view of FIG. 2, the BMA layer 14 has a downwardly facing side (with synthetic BMA seta) for adhesion to human skin, and its upwardly facing side is fastened to a downwardly facing side of the wig netting, such as by a polymer or adhesive glue layer fused or adhered to the wig netting or mesh material. The shaped piece of wig netting 10 is dimensioned to be slightly larger than the BMA layer so as to leave a slight overhanging part 12 extending beyond the BMA layer 14 to facilitate removal. In this embodiment, the overhanging part consists of net loops around the edges of the wig netting that overhang the matching shaped BMA layer. Alternatively, the overhanging part can consist of edges of a substrate layer of the shaped piece of wig netting that extend around and slightly beyond the periphery of the BMA layer.

The cosmetic hair assembly is installed by placing an appropriately shaped piece of the strip or patch on a bare spot of the wearer's scalp with the downwardly facing adhesion side of the BMA layer in contact with the wearer's skin. Adhesion can be enhanced by pushing or pressing down on the strip or patch during placement or moving it with a slight to-and-fro motion parallel to the surface of the skin for preloading the synthetic setae. The high adhesion force generated by the BMA layer ensures that the cosmetic hair assembly remains securely in place during use. The emplaced patch or strip of hairs can then be colored and styled as needed, by itself or with the natural hairs of the user, or a patch with color-resistant hairs can also be offered as an option.

The cosmetic hair assembly can be easily removed by peeling back the wig netting or mesh 10, and the BMA layer 14 attached to it, with a comb or other removal device used in a peeling operation to snag loops on any part of the wig overhang 12 and pull the netting at an inclined angle back from the scalp (direction of the arrows in the figure). This has the effect of easily releasing the seta of the BMA layer 14 from the skin by "peeling" it back. In a preferred embodiment, a specially designed comb 16 has a peeler in the form of small hooked portions at the ends of the comb's teeth for hooking the overhanging loops of the wig netting 10 and peeling the cosmetic hair assembly from the scalp.

FIGS. 3A, 3B, and 3C show plan, elevation, and front views of a preferred embodiment of a comb with peeler for removing the cosmetic hair assembly from the scalp. Each tooth of the comb has a jogged portion on its free end hooked in a direction transverse to the comb axis. With this configuration, the comb can simply be moved with a combing action parallel to the surface of the scalp to hook the exposed loops of an overhang portion of the wig netting for peeling the cosmetic hair assembly away from the scalp. The jogged portion is preferably short, slender, curved hook with a rounded point (free end) and is preferably made from a solid material such as plastic or rubber. The jogged portion and the rest of the tooth are formed integrally, preferably of the same material.

The BMA layer and wig netting are shaped to make them inconspicuous in use. A pre-shaped piece may also be cut to a size or shape for a better fit to the bald spot the user wants to cover. The method of applying the wig with high adhesion forces generated by the BMA layer and readily removing it by hooking an overhang portion and simply peeling the wig netting back provides a greatly improved cosmetic hair solution for problems of baldness and thinning hair problems. Shaped pieces of cosmetic hair assembly and comb with peeler can readily be packaged as a product and made available at convenience stores.

The synthetic BMA layer's unique adhesion properties are provided by millions of tiny hairs (or carbon nanotubes) formed with mushroom shaped caps (about a millimeter across) on the ends, mimicking the hairs such as found on a gecko's feet. The hairs are rooted in the wig netting or mesh made of a flexible, transparent or skin-colored substrate. Once attached to a surface, the BMA layer can only be detached in normal use by the peeling action. Due to removal by the peeling action, the BMA layer is self-cleaning and can attach-detach multiple times without leaving any residue. For a further description of the characteristics and advantages of using BMA adhesive layers for attachment to human skin, reference is made to U.S. patent application Ser. No. 11/849,341, filed on Sep. 3, 2007, of the same inventor, entitled "Adhesion Device for Applying and Releasing Biomimetic Microstructure Adhesive from a Contact Surface", which is deemed to be incorporated herein in its entirety.

The wig netting or mesh of the cosmetic hair assembly can be fabricated in the same manner as conventional wigs. For the hairline and frontal portion of the head applications, the hairs attached to the wig netting should consist of many single strands of hair (with short root ends) individually knotted, fused, or adhered to the fine mesh netting. In addition, the single strand of hair should be made stable in multiple directions as dictated by the geometry of the fine mesh netting. Single strands of hair are also attached along the perimeter (edge) of the fine mesh netting. In contrast, for the crown, nape, back, and sides of the head applications, the hairs of the wig netting can consist of units or conjoined groups of multiple strands of hairs attached at one point to the fine mesh netting. FIG. 4 illustrates the attachment of groups of hair strands at discrete points to the wig mesh or netting. The comb with peeler is used to peel off the wig netting with hair groups in the same way as described above for a wig piece having individual strands of hair attached to its substrate. The root ends of the hairs can be bleached to make them inconspicuous.

For certain parts of the wig netting, polyurethane, silicone, or polygauze membranes may be used in place of fine mesh netting. Hair strands can be attached to the membranes using U-loop, knotting, and/or forced injection. Hair direction must be carefully selected when injecting hairs in the membrane.

The shaped piece of BMA layer is bonded on its non-hair side to the non-hair side of the shaped piece of wig. The fine mesh netting of the shaped piece of wig is formed in a similar shape as the shaped piece of BMA layer but with a certain amount of overhang that is used to peel off the cosmetic hair from the scalp. If a membrane is used, it would be formed in the same shape as the shaped piece of BMA layer. The overhang consists of mesh or netting loops extending around the perimeter of the BMA layer to aid in snagging and peeling the cosmetic hair.

In some small bald areas or thinning frontal hairline parts of the head, it is preferred to apply individual strands of hair or a individual groups of hairs. As a further embodiment of the invention, an individual strand or group of cosmetic hair will now be described. Referring to FIG. 5, an individual cosmetic hair assembly has a shaped substrate portion 52 with a downwardly facing side attached to a correspondingly shaped biomimetic microstructure adhesive (BMA) layer 54. The BMA layer 54 has a downwardly facing side with synthetic BMA seta for adhesion to human skin. The upwardly facing side of the substrate portion 52 has the end of a hair shaft 50 embedded, injected, adhered, or otherwise attached. The hair shaft 50 has a stress relief portion 50*a*. The hair shaft 50 is preferably formed as a solid, slender filament made of a flexible, style-able, color-able, resilient, hypoallergenic material such as synthetic fibers. The stress relief is preferably hour-glass shaped, and is formed as part of the hair shaft fiber. The stress relief allows the hair shaft to bend naturally in one direction or another for a more natural look. The emplaced hairs can then be colored and styled as needed, by themselves or with the natural hairs of the user, or color-resistant hairs can also be offered as an option.

FIGS. 6A, 6B, and 6C show plan, elevation, and front views of a preferred embodiment of an applicator for applying the individual cosmetic hair to the user's head. The applicator is formed as a transfer sheet 56 for holding one or more of the cosmetic hair until they are ready to be applied. The sheet is preferably formed as a thin rectangular layer of a water-soluble, flexible, non-stick material. Each cosmetic hair is embedded in the sheet 56 lengthwise with its BMA layer 54 exposed all on the same side. Each embedded cosmetic hair is preferably aligned in parallel to an edge of the sheet and to each other. The hair shafts of the cosmetic hairs of the applicator can all have the same length or a variety of different lengths. The embedding of the hairs can be accomplished, for example, by spraying or painting a thin film of liquid polymer onto and over the retention parts of the hairs, then drying the film to a solid layer.

In operation, the applicator sheet 56 is rolled into a cylinder with the BMA layer ends exposed at one end. The existing hairs on a bald head are then parted to expose a small bald spot. Gripping the sheet rolled into a cylinder and then pressing the BMA end of the cylinder against the bald spot results in attachment of the hair ends to the skin in the bald spot. The hairs will remain embedded in the transfer sheet rolled into a cylinder. After the user has attached all the individual hairs desired, the transfer sheets rolled into cylinders are wetted with water (or other solvent) to dissolve the sheet material and leave the cosmetic hairs in place on the head. The hairs can then be colored and styled as needed.

FIG. 7 shows a comb peeler for releasing the individual cosmetic hair from the user's head, which is similar to the comb with peeler previously described for removing the netting or mesh-type of cosmetic hair assembly. Each tooth of the comb has a jogged portion on its free end hooked in a direction transverse to the comb axis. The peripheral edges of the substrate portion of the hair shaft subassembly provide engagement surfaces to facilitate removal of the cosmetic hair assembly from the skin by peeling back the BMA layer. To remove the cosmetic hair assembly, the peeler is dragged multiple times in the inclined direction of the jogged portions of the comb teeth over the installed hair assemblies on the bald spot(s). The free ends of the jogged portions catch under the substrate edges of each of the hairs' BMA layers to peel off the cosmetic hairs.

Although the above described embodiment shows a single hair shaft filament attached to a single BMA layer, it is understood that other modifications may be made within the principles of the invention disclosed. Multiple hair shafts of the same or varying lengths can be attached to one BMA layer to form a single group of cosmetic hairs. The hair shaft need not be a solid filament, but can have a hollow center that could optionally be filled with a different material. Real hair can also be used by embedding in a hair shaft substrate. The stress relief can be formed with an elastic characteristic, or eliminated if the hair shaft is sufficiently flexible. The BMA layer and the hair shaft subassembly can be formed separately then attached together with adhesive, or formed in one process. In lieu of water-soluble material, the transfer sheet may employ other transfer methods, such as by using heat- or chemical-dissolving materials, to accomplish the same objective. The cosmetic hairs of the applicator can be retained on the surface of the sheet instead of being embedded inside. The applicator can be a non-soluble unit for dispensing a single hair shaft or group on one BMA layer at a time. Besides bald spots on the head, the invention can also be applied to other areas where hair is desired, such as for thinning eyebrows or eyelashes The cosmetic hair system and method of the present invention enables baldness and thinning hair problems to be restored with a natural look, quickly, and easily. Product packages can be customized for particular hair colors, textures, lengths, part of the head to be treated, etc. Standardized packages of cosmetic hair can be sold in retail stores and other convenience outlets.

It is understood that many modifications and variations may be devised given the above description of the principles of the invention. It is intended that all such modifications and variations be considered as within the spirit and scope of this invention, as defined in the following claims.

The invention claimed is:

1. A method of applying cosmetic hair to a bald spot area exposing the skin of the scalp of a user, comprising:

providing small incremental carrier strips or patches of cosmetic hair carried on a transfer medium, each said small strip or patch being formed as a shaped unit piece of base netting or mesh holding a plurality of hairs on an upwardly facing side thereof, and a correspondingly shaped base layer of biomimetic microstructure adhesive (BMA) having tiny synthetic seta as an adhesive medium on a downwardly facing side thereof for adhesion to human skin on the scalp in the bald spot area of the user, wherein each shaped unit piece of base netting is dimensioned to be slightly larger than the BMA layer so as to leave a slight overhanging part extending beyond the BMA layer to facilitate removal of each shaped unit piece;

applying one or more of said small incremental carrier strips or patches of cosmetic hair one at a time with the base layer of BMA adhesive medium placed in contact with the skin in the bald spot of the user so that the carrier strip or patch adheres thereto, and continuing to apply said incremental carrier strips or patches as needed to cover the exposed skin in the bald spot area; and removing small incremental carrier strips or patches of cosmetic hair when they are no longer needed or desired to be kept on the scalp of the user by releasing the BMA adhesive medium from the skin using a hooking tool to grasp and peel back the overhanging part extending beyond the BMA layer of each shaped unit piece from the skin of the user's scalp.

2. A cosmetic hair method according to claim 1, wherein the base netting is made of loops of netting material, and the overhanging part consists of looped ends that extend beyond the periphery of the shaped BMA layer.

3. A cosmetic hair method according to claim 1, wherein the base netting or mesh has a incremental unit shape matching the BMA layer, and the overhanging part consists of edges of the shaped piece that extend around the periphery of the BMA layer.

4. A cosmetic hair method according to claim 1, further comprising providing a comb device as a hooking tool for use in removing incremental carrier strips or patches of cosmetic hair from the user's skin, said comb device having a peeler in the form of small hooked portions at ends of the comb's teeth for hooking the overhanging part of the shaped piece of base netting and peeling the incremental carrier strip or patch of cosmetic hair back from the skin.

5. A cosmetic hair method according to claim 4, wherein the small hooked portions extend at an inclined angle to the comb teeth in a direction transverse to the comb.

6. A cosmetic hair method according to claim 1, wherein individual hairs are attached to discrete points of the base netting or mesh.

7. A cosmetic hair method according to claim 1, wherein individual groups of hairs are attached to discrete points of the base netting or mesh.

8. A method of applying cosmetic hair to a bald spot area of a head comprising:

providing a cosmetic hair assembly comprising small incremental carrier strips or patches of cosmetic hair carried on a transfer medium, each said small strip or patch being formed as a shaped unit piece of base netting or mesh holding a cluster plurality of hairs on an upwardly facing side thereof, and a correspondingly shaped base layer of biomimetic microstructure adhesive (BMA) having tiny synthetic seta as an adhesive medium on a downwardly facing side thereof for adhesion to human skin on the scalp in a bald spot area of the head, wherein each shaped unit piece of base netting is dimensioned to be slightly larger than the BMA layer so as to leave a slight overhanging part extending beyond the BMA layer to facilitate removal of each shaped unit piece from the user's skin;

providing a means to enable a user to apply the small incremental carrier strips or patches of cosmetic hair from the transfer medium to human skin on the scalp in a bald spot area of the head; and providing a means to enable a user to remove the small incremental carrier strips or patches of cosmetic hair from the human skin on the scalp in the bald spot area of the head.

9. A cosmetic hair method according to claim 8, wherein each hair shaft has a stress release portion for allowing the hair shaft to bend with a natural look.

10. A cosmetic hair method according to claim 8, wherein each individual hair shaft is attached to a substrate portion.

11. A cosmetic hair method according to claim 8, wherein a group of hair shafts are attached to a substrate portion.

12. A cosmetic hair method according to claim 8, wherein the transfer medium is an applicator transfer sheet carrying a plurality of units of small incremental carrier strips or patches of cosmetic hair until they are ready to be applied.

13. A cosmetic hair method according to claim 12, wherein the applicator transfer sheet is formed as a thin layer of a water-soluble, flexible, non-stick material in which the units of small incremental carrier strips or patches of cosmetic hair are embedded with their BMA layer exposed on one side of the transfer sheet.

14. A cosmetic hair method according to claim 13, wherein the applicator transfer sheet holds a plurality of cosmetic hair assemblies having their BMA layer ends exposed on the same side of the transfer sheet.

15. A cosmetic hair method according to claim 14, wherein the applicator transfer sheet is adapted to be rolled up in a cylindrical shape with the BMA layer ends exposed on the same side of the transfer sheet for conveniently applying a plurality of units of small incremental carrier strips or patches of cosmetic hair to a bald spot.

16. A cosmetic hair method according to claim 8, further comprising a comb device for use in removing the units of small incremental carrier strips or patches of cosmetic hair from the user's skin, said comb device having a peeler in the form of small hooked portions at ends of the comb's teeth for hooking the edges of the substrate portion and peeling the cosmetic hair units back from the skin.

17. A cosmetic hair method according to claim 16, wherein the small hooked portions extend at an inclined angle to the comb teeth in a direction transverse to the comb.

* * * * *